US005953885A

United States Patent [19]

Berman et al.

[11] Patent Number: 5,953,885

[45] Date of Patent: Sep. 21, 1999

[54] COSMETIC SAMPLER AND METHOD OF MAKING USING BULK THIN FILM APPLICATION TECHNIQUES

[75] Inventors: Michael J. Berman, Southampton, Pa.; William Deierlein, Plainsboro, N.J.; Michael Parrotta, Churchville, Pa.; Phillip Cameron, Warrenville; Allan Cameron, III, Willowbrook, both of Ill.

[73] Assignee: Retail Communications Corp., New York, N.Y.

[21] Appl. No.: 08/841,964

[22] Filed: Apr. 8, 1997

[51] Int. Cl.[6] ..... B65B 9/02; B65B 11/48; B65B 29/00

[52] U.S. Cl. ..... 53/431; 53/435; 53/450; 53/455; 53/553

[58] Field of Search ..... 53/553, 450, 485, 53/455, 550, 281, 373.3, 375.5, 375.4, 431, 428, 435; 206/484

[56] References Cited

U.S. PATENT DOCUMENTS

| | | | |
|---|---|---|---|
| 4,433,783 | 2/1984 | Dickinson | 206/484 |
| 4,492,306 | 1/1985 | Cooper et al. | 206/216 |
| 4,493,869 | 1/1985 | Sweeny et al. | 428/201 |
| 4,661,388 | 4/1987 | Charbonneau | 428/43 |
| 4,720,417 | 1/1988 | Sweeny et al. | 428/201 |
| 4,725,495 | 2/1988 | Garbe et al. | 428/335 |
| 4,751,934 | 6/1988 | Moir et al. | 132/79 |
| 4,752,496 | 6/1988 | Fellow et al. | 427/27 |
| 4,755,433 | 7/1988 | Patel et al. | 428/422 |
| 4,786,534 | 11/1988 | Aiken | 428/34 |
| 4,817,367 | 4/1989 | Ishikawa et al. | 53/553 X |
| 4,848,378 | 7/1989 | Moir et al. | 132/319 |
| 4,863,784 | 9/1989 | Lustig et al. | 428/218 |
| 4,876,136 | 10/1989 | Chang et al. | 428/130 |
| 4,878,775 | 11/1989 | Norbury et al. | 401/132 |
| 4,880,690 | 11/1989 | Szycher et al. | 428/224 |
| 4,883,197 | 11/1989 | Sanchez et al. | 221/26 |
| 4,884,680 | 12/1989 | Israel et al. | 206/44 |
| 4,884,719 | 12/1989 | Levine et al. | 221/25 |
| 4,889,755 | 12/1989 | Charbonneau | 428/42 |
| 4,890,872 | 1/1990 | Parrotta et al. | 283/56 |
| 4,923,063 | 5/1990 | Tararuj | 206/484 |
| 4,925,517 | 5/1990 | Charbonneau et al. | 156/276 |
| 4,925,667 | 5/1990 | Fellows et al. | 424/401 |
| 4,940,584 | 7/1990 | Tararuj et al. | 424/401 |
| 4,952,400 | 8/1990 | Tararuj et al. | 424/401 |
| 4,968,061 | 11/1990 | Bullard, Jr. | 281/15 |
| 4,988,124 | 1/1991 | Hudetz | 283/56 |
| 4,988,465 | 1/1991 | Lustig et al. | 264/22 |
| 4,988,557 | 1/1991 | Charbonneau | 428/204 |
| 4,995,408 | 2/1991 | Wallschlaeger | 132/320 |
| 5,037,139 | 8/1991 | Schoenleber et al. | 283/56 |
| 5,050,910 | 9/1991 | Schechter et al. | 283/105 |
| 5,072,831 | 12/1991 | Parrotta et al. | 206/232 |
| 5,188,236 | 2/1993 | Sayers et al. | 206/527 |
| 5,192,386 | 3/1993 | Moir et al. | 156/268 |
| 5,197,599 | 3/1993 | Dolan | 206/232 |
| 5,248,537 | 9/1993 | Giannavola | 428/40 |
| 5,389,174 | 2/1995 | Hibsch et al. | 156/200 |
| 5,391,420 | 2/1995 | Bootman et al. | 428/195 |
| 5,419,958 | 5/1995 | Charbonneau | 428/315 |
| 5,439,172 | 8/1995 | Comyn et al. | 239/34 |
| 5,445,821 | 8/1995 | Brown et al. | 424/401 |
| 5,459,980 | 10/1995 | Kenney et al. | 53/450 |
| 5,488,816 | 2/1996 | Grage, Jr. et al. | 53/553 X |

*Primary Examiner*—James F. Coan
*Attorney, Agent, or Firm*—Ryndak & Lyerla

[57] ABSTRACT

A method for producing cosmetic samplers that incorporates the genuine cosmetic through the use of bulk thin film application techniques such as extrusion or spray technology. The method comprises first applying a cosmetic slurry to a base substrate and then attaching a cover sheet by means of an adhesive on either wide-web offset or label equipment.

33 Claims, 10 Drawing Sheets

COSMETIC SAMPLER AND METHOD OF MAKING USING BULK THIN FILM APPLICATION TECHNIQUES

FIELD OF THE INVENTION

The present invention relates to a cosmetic sampler that incorporates the genuine cosmetic and a method of making a cosmetic sampler by application of a cosmetic to a substrate such as paper through the use of bulk thin film application techniques.

BACKGROUND OF THE INVENTION

Traditionally, cosmetics have been packaged in containers such as bottles, jars, flasks, boxes, compacts and tubes. More recently, cosmetics have been placed in sampling devices for use in magazine inserts, postcards, department store catalogs and billing cycles and other sales promotion vehicles, and have been used as store handouts. The sampling devices contain a small quantity of cosmetic or a substance simulating a cosmetic which can be removed and applied to the skin by a consumer.

Cosmetic samplers have been manufactured in the past on web equipment using (a) flexography printing of the cosmetics, (b) a bump plate or (c) continuous extrusion.

Currently, cosmetic sampling devices are produced using silk-screen printing in a printing environment. This current method cannot be used in conjunction with a carrier liner and pressure sensitive backing. This means that such a cosmetic sample can only be affixed to another substrate by hot melt dispensers or by hand. These processes are relatively slow and expensive. Additionally, the silk screen printing method itself is relatively economically unfeasible; it requires multiple manufacturing steps to produce a finished product.

One need that exists is mass producing cosmetic samples at an inexpensive price. Cosmetics are typically dry or cohesive powders, or oily or emulsion-type dispersion or easily meltable pastes which have a very defined appearance and feel. Any attempt to apply the cosmetic to a substrate requires that the cosmetic not bleed or leak or stain in the substrate, nor can the cosmetic itself be altered in its own final color, feel or appearance. To be printable, the cosmetic must be provided in a fluidized or amorphous paste form.

A method disclosed in U.S. Pat. No. 5,072,831 provides a transfer layer of a colored heavy, waxy oily material, removable by fingertip and spreadable by skin, in forming an advertising sampler. However, this sampler is made from a composition which is intended to provide only a color match to that of the genuine cosmetic product advertised. The sampler does not contain the actual cosmetic product advertised. A need exists to form a cosmetic sampler encompassing the actual cosmetic advertised. Additionally, a method disclosed in U.S. Pat. No. 4,925,667 provides a sampler formed using microencapsulated cosmetic capsules. Such microencapsulation enables the cosmetic to adhere to the substrate while still maintaining the desirable characteristics of the cosmetic. Col. 3, lines 41–46. However, such method does not teach the use of a non-microencapsulated cosmetic in a sampler.

Additionally, a method disclosed in U.S. Pat. No. 5,192,386 teaches application of cosmetics to a treated substrate using screen printing. This sampler does not utilize bulk thin film application, i.e., non-printing technology. A need exists to produce cosmetic samplers using non-printing technology.

SUMMARY OF THE INVENTION

In accordance with one aspect of the invention, a cosmetic sampler is formed using wide-web offset or gravure printing machinery with in-line finishing capability with cosmetic application of the genuine cosmetic to be sampled being done by bulk thin film techniques. Print stations are used for printing conventional information and not for cosmetic application. For example, indicia, visible to a user of the sampler prior to opening it, which may be printed or otherwise, may be provided on the cosmetic sampler identifying the specific type and brand, including by trademark or otherwise, of the actual cosmetic contained in the sampler. Cosmetics are applied using a bulk thin film technique, i.e., non-printing technology, in the in-line finishing line such as by pulsed, metered on-demand spraying or pulsed, metered on-demand extrusion, for example.

In accordance with another aspect of this invention, a cosmetic sampler is formed using narrow-web roll-to-roll machinery, for example, machinery traditionally used to produce labels. Cosmetics are applied using a bulk thin film technique, i.e., non-printing technology such as by pulsed, metered on-demand spraying or extrusion, or continuous spraying, for example. This method enables economical mass production of cosmetic samplers of various configurations, including delivery of a sample on a carrier liner for inexpensive, fast dispensing and affixing.

In accordance with another aspect of the present invention, a cosmetic sampler can be mass produced utilizing the genuine cosmetic and not an ersatz cosmetic that imitates the color of the genuine cosmetic. Consumers most likely would prefer to view and sample the actual cosmetic to enable them to accurately match color, look and feel.

In accordance with yet another aspect of the invention, pulsed, metered spraying or pulsed, metered extrusion application is utilized for efficient bulk thin film application of the cosmetic slurry. Pulsing or intermittent application provides cosmetic application in discrete spaced apart areas on a substrate web. By using less cosmetic during the process, the overall cost of each cosmetic sampler is reduced.

In accordance with yet another aspect of the invention, continuous spraying application is utilized for a uniform bulk thin film application of the cosmetic. In the context of certain design configurations, continuous spraying creates more efficient use of the bulk cosmetic, allows faster press speeds, and uses less paper in manufacturing. These advantages may outweigh the cost of spraying excess cosmetic which is not used in the final product, and the overall unit cost of cosmetic samplers may be less using continuous spraying.

By "genuine cosmetic" it is meant that the cosmetic slurry that is applied as a thin film which is incorporated into the sampler includes the genuine, actual cosmetic, and is not an imitation or ersatz cosmetic composition that attempts to mimic the color of the genuine cosmetic composition as in U.S. Pat. No. 5,072,831.

DETAILED DESCRIPTION OF THE INVENTION

Figure 1:
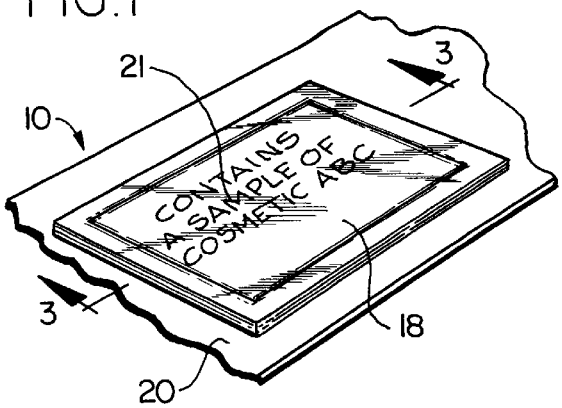
FIG. 1 is a perspective view of a sampler containing one cosmetic covered by a cover substrate.
Figure 2:
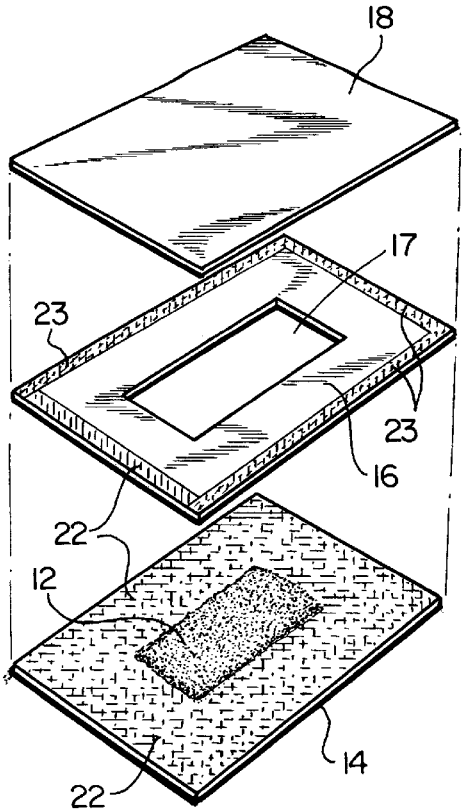
FIG. 2 is a perspective view of the layers which form the sampler of FIG. 1.
Figure 3:
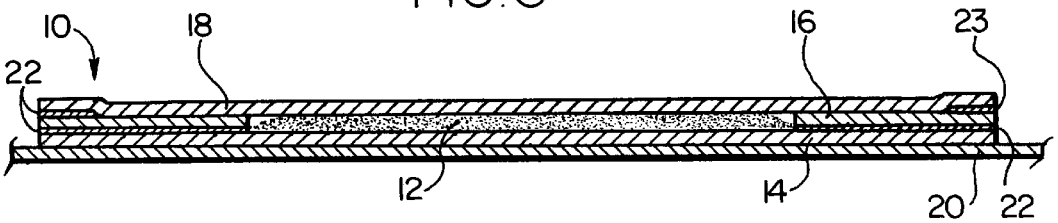
FIG. 3 is a cross-sectional view of the sampler of FIG. 1 taken along line 3—3.

Referring to the figures generally, and specifically to FIGS. 1, 2 and 3, there is illustrated a cosmetic sampler 10. Cosmetic sampler 10 can be comprised of several layers, including base 14, intermediate layer 16, cover 18 and liner layer 20. Cosmetic sampler 10 is a relatively flat sampler for use in bind-ins, catalogs, statement enclosures, remittance envelopes and postcards. A layer of cosmetic 12 which can be tested and compared by a consumer is present on a base 14. Typically, an intermediate layer 16 with die cut area 17 is affixed to base 14 by means of adhesive 22 for example. Cover 18, which may contain printing on one or both sides can be affixed to the sampler with peelable and, if desired, permanent adhesive 23. Cosmetic sampler 10 can be affixed to a liner layer 20 or other pressure sensitive adhesive backing or similarly functioning layer. Cosmetic sampler 10 includes printed indicia 21, preferably identifying the actual cosmetic contained therein.

Figure 4:
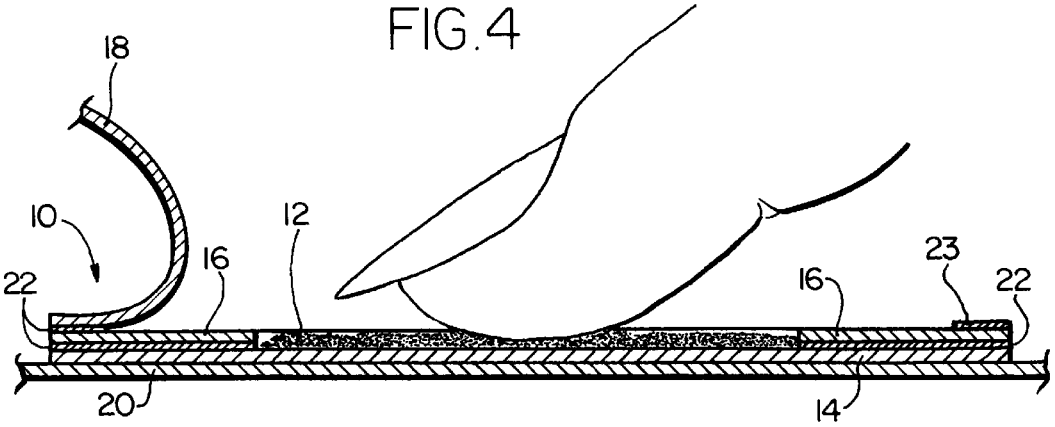
FIG. 4 is a cross-sectional view of the sampler of FIG. 1 taken along line 3—3 showing the cover substrate pulled back and the cosmetic being removed from the sampler.

Referring to FIG. 4, there is illustrated a cosmetic sampler 10 which has cover 18 peeled back. Permanent adhesive at area 22 prevents cover 18 from separating from intermediate layer 16 and base 14. When cover 18 is peeled back from cosmetic sampler 10, a consumer is able to remove cosmetic 12 from base 14 by applying pressure. Cosmetic 12 can then be applied to the skin and compared for color, texture and other desired characteristics by the consumer. For purposes of the present invention, the term "cosmetics" refers to eye shadows, blushers, bronzers, foundations and other products, presented in a powder or creamy powder or creamy final form, which are applied to parts of the human body for purposes of enhancing appearance. Cosmetics can be either liquid or powder. The above definition of "cosmetics" specifically excludes lipsticks or other hot pour liquid products.

For purposes of the present invention, the term "sprayin-g"refers to pushing or thrusting materials through an orifice by means of independent pressure, such as air pressure, or airless system, such as using harmonic vibration, to propel the cosmetic slurry onto the substrate from a distance, usually from about 0.025" to about 4.00" from the end of the orifice. For purposes of the present invention, the term "extrusion" brefers to injecting the material to be applied through an orifice usually of specific shape and area, which orifice is directly, or substantially directly, in contact with the paper or substrate to which the cosmetic slurry is to be applied. For purposes of this invention, "kiss cut die cutting" refers to die cutting by any suitable means through at least one but not all of the layers in a construction.

In preparation for application of the cosmetic, certain additives may be added to the genuine cosmetic. This forms a cosmetic slurry with a composition suitable for use with bulk thin film techniques, such as spraying or extrusion. Such a composition may include (by weight) between about ten percent and about ninety percent bulk genuine cosmetic; up to about eighty percent volatizing solvent; between about 0.1 percent and about two percent lubricant; between about 0.025 percent and about 0.25 percent preservatives; up to about three percent rheological and processing agents; and up to about seven percent adhesion/cohesion promoters and rheological agents.

The genuine bulk cosmetic may be supplied in liquid or powder or any other form or phase which is capable of being transformed into a composition suitable for bulk thin film application techniques, such as spraying or extrusion. Each particular genuine bulk cosmetic has a different optimal mixture of solvents, lubricants, and other additives. The choice of optimal overall composition is also dependent on the method of application, i.e., whether the slurry is applied by spraying, extrusion or other means, the color shift of the cosmetic, the removability of the cosmetic, and other factors. It is possible that different compositions of the genuine cosmetic and additives will produce useable cosmetic samplers. The viscosity of the cosmetic slurry should be suitable for the bulk thin film application technique being utilized, i.e., spraying or extrusion. The viscosity is preferably between about 50 cps and 500 cps for spraying, and between about 600 cps and 2000 cps for extrusion. Additionally, the optimal composition should achieve a final cosmetic sample that accurately matches what the actual cosmetic looks like on the skin.

A volatizing solvent may be added to the genuine bulk cosmetic to promote rapid drying and a uniform thin layer of applied genuine cosmetic. The volatizing solvent may be composed of, for example, isopropyl alcohol, N-propyl acetate, ethanol and hydrocarbons (aliphatic and aromatic). The choice of volatizing solvent is effected by a variety of factors including the desired laydown and drying characteristics of a particular genuine cosmetic.

Lubricants may be useful in the present invention to provide a smooth texture within the cosmetic in the final product. The lubricants which may be added to the genuine cosmetic in the present invention may include polysiloxane, cyclomethicone, dimethyl-siloxane, dimethicone or other similar silicone base compounds, for example.

Preservatives may be added to the bulk cosmetic to improve the shelf life of the cosmetic. Preservatives improve the shelf life both during processing and during storage of the genuine cosmetic. These preservatives may be methyl paraben, propyl paraben or other similarly functioning preservative, for example.

The adhesion/cohesion promoters include, but are not limited to, the stearate family such as methyl sesquistearate, mineral oil, fumed silica, fatty alcohols and cellulosics. Materials which include silicon, silicates and metallic stearates may be used in combination with rheology control agents to provide finished cosmetic characteristics such as adhesion and cohesion.

The rheological and processing agents such as, for example, propylene glycol, glycerine, sorbitol or other similarly glycol-based compounds may be added to the genuine cosmetic. These ingredients aid in providing a finished product with sufficient humectancy.

Optionally, microencapsulated emollients, such as vitamin E or isopropyl myristate for example, may be added to the cosmetic slurry. These emollients may make the cosmetic feel smoother when applied to the skin.

For all of the embodiments of the present invention, the base substrate should be suitable to contain a cosmetic without bleeding or staining through while allowing the cosmetic to be readily removable. The base substrate may be composed of coated or uncoated paper or plastic film such as polypropylene or mylar, or a combination of these. Additionally, a film carrier or liner layer, such as forty pound paper, coated with a release liner may be present as part of the base substrate. The thickness of the base substrate should be between 1 mil and 12 mil. In some embodiments of the present invention, the base substrate consists of one or more layers of paper with a polypropylene layer. These layers can be assembled to form one web of base substrate in a separate area using, for example, Hot Melt 2107 H.B. Fuller permanent adhesive. For example, equipment 60 shown in FIG. 5 requires a base substrate of at least two layers. For this embodiment, 1 layer of 40 pound coated 2 sided paper, 1 layer of 40 pound coated 1 sided paper, and one layer of 2 mil polypropylene may be used and assembled with adhesive. The paper carrier layer may be treated with silicone or similarly functioning substance to enable easy removal during the process.

The cover substrate, and if desired, intermediate substrate, may be comprised of paper or any other suitable material for enclosing the cosmetic. Die-cut areas may be registered to correspond roughly with the areas of cosmetic. However, the die-cut areas may be slightly smaller than the area of cosmetic to create a bleed area beyond the open area. Additionally, the die-cut areas may be slightly larger than the area of the cosmetic. Moreover, the cover substrate may be folded in half to function as both a cover and an intermediate layer.

Substrates may be adhered to each other by use of a permanent adhesive, such as, for example, Flexacryl LC-14. Additionally, to allow the cover substrate to be peelable, an adhesive, such as, for example, National Starch 38-4536 or Craigbond 3991PLV may be used on some or all edges of the substrates. The cover substrate may be connected to the cosmetic sampler by an edge of permanent adhesive which will form a hinge if the substrate held by the peelable adhesive is removed. Substrates may be combined together by lamination or any suitable means.

The present invention is a method of applying cosmetics to a substrate such as paper through the use of a bulk thin film technique, such as non-printing technology which forms a sheet of cosmetic samplers. The present invention may be operated on at least two types of equipment: a narrow-web roll-to-roll machinery or a wide-web offset press. Additionally, the present invention may utilize any other suitable method for mass producing cosmetic samplers. Separate stages within the narrow-web or web offset equipment are often used for applying the cosmetic slurry, drying the slurry, applying the adhesive, and applying the cover substrates. Narrow-web roll-to-roll machinery may be acquired from any suitable source including Webtron of Ft. Lauderdale, Fla., or Mark Andy of Chesterfield, Mo. Material can be fed through the narrow-web equipment at speeds of between about 75 and 300 feet per minute.

Figure 5:
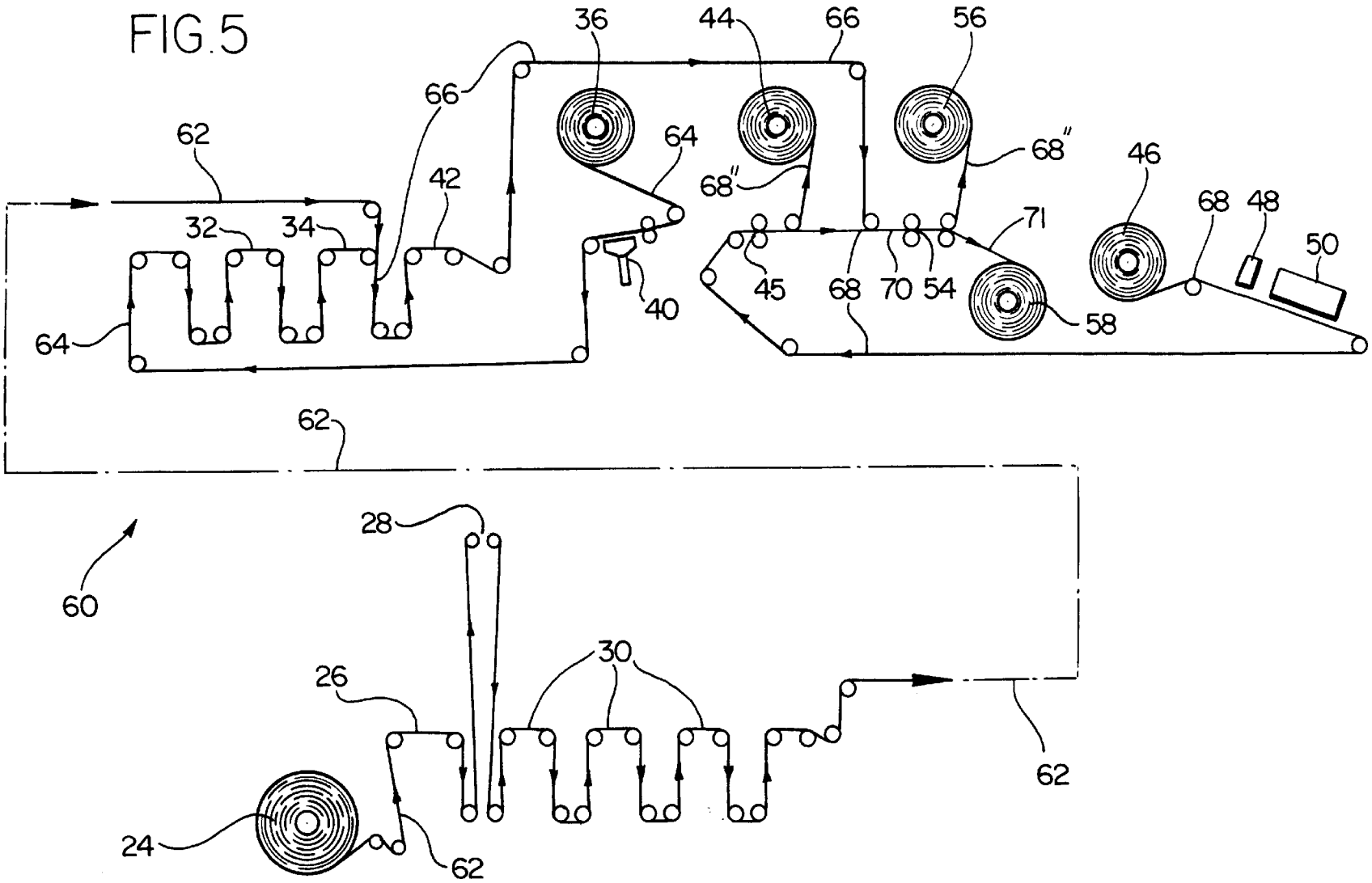
FIG. 5 is a diagrammatic view showing the steps of producing a cosmetic sampler using a narrow-web roll-to-roll three web machine.
Figure 6:
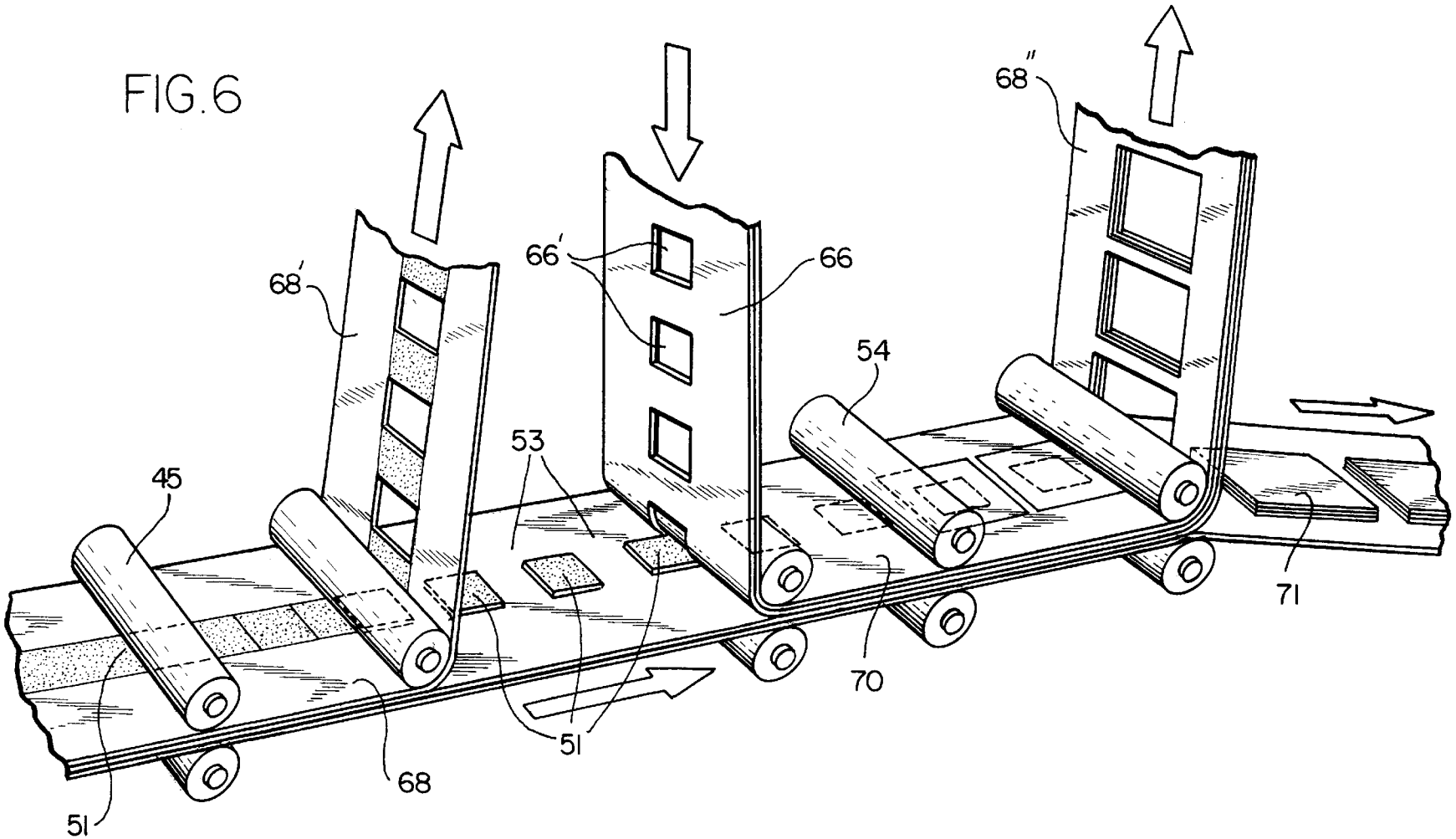
FIG. 6 is an enlarged diagrammatic view of the machine in FIG. 5 showing the final steps in producing a cosmetic sampler.

Referring to FIGS. 5 and 6, equipment 60, the preferred embodiment of the narrow-web machinery, is shown. Equipment 60 consists of three separate webs of substrates web 24, web 36 and web 46. These three webs at some point merge to form product rewind 58. All three webs are run simultaneously and at the same speed. Web 24 runs a cover substrate 62 across print stations 26 and 30. Print stations 26 and 30 print advertising or other desired material on the cover of the sampler by conventional means, such as by use of flexographic printing plates. Additional print stations may be utilized for printing additional colors or details. Turnbar 28 may also optionally be employed to reverse cover substrate 62 onto its back side to facilitate printing on both sides in multiple colors.

The second web, web 36 feeds substrate 64 at the same speed as web 24 feeds cover substrate 62. Substrate 64 is die cut by any suitable means to allow for the removal of an area of substrate 64 suitable for viewing and accessing a genuine cosmetic in the finished cosmetic sampler. Such die cut area is removed from substrate 64 by vacuum pump 40 or any other suitable means. Next, substrate 64 is delivered to deck 32 where peelable glue is applied. The glue is applied to at least a portion of one edge of one side of substrate 64 by any suitable method. Typically, for example, three edges of one side of substrate 64 are covered with peelable glue to allow a consumer to peel back this cover from the final cosmetic sampler. Substrate 64 is next fed into deck 34 where permanent adhesive is applied to at least a portion of one edge of one side of substrate 64. The permanent glue is used to prevent the cover from becoming separated from the cosmetic sampler during use by a consumer of the final product. However, if a final cosmetic sampler is desired to have a completely removable cover, application of the permanent glue is not necessary. The permanent and peelable glue are applied in different locations of the same side of substrate 64. In the alternative, the permanent and peelable glue may be applied to cover substrate 62.

Thereafter, cover substrate 62 is attached to substrate 64 to form combined substrate 66, such that the peelable glue and, if appropriate, permanent adhesive, adhere the substrates together. Cover substrate 62 can be attached to substrate 64 by laminating or any other suitable means. Combined substrate 66 may then be coated with an ultra violet curable varnish and cured with ultra violet lamps or similarly treated at deck 42 to provide for a smooth protected finish.

Web 46 feeds base substrate 68 into equipment 60 at the same speed that web 24 and web 36 feed cover substrate 62 and substrate 64, respectively. In the preferred embodiment, base substrate 68 consists of 3 layers: 2 layers of paper and 1 layer of silicone treated polypropylene. At station 48, the genuine cosmetic slurry is applied to substrate 68 using bulk thin film techniques, such as continuous spraying, pulsed, metered spraying, or pulsed, metered extrusion. Details of the spraying and extrusion systems are provided below. Multiple types or colors of the genuine cosmetic may be applied side by side or in any other configuration on base substrate 68 using bulk thin film techniques, such as by multiple parallel sprayers or extruders, to create a cosmetic sampler containing several different genuine cosmetics. The cosmetic slurry, after being applied to the base substrate, should be suitably dried to form a powder layer 51. The cosmetic or cosmetics are dried by oven 50 or other suitable means. Additionally, the air may dry the cosmetic as base substrate 68 is carried. The faster the speed of web 46, the quicker the cosmetic slurry will air dry. In addition, it may be desirable to run base substrate 68 with the cosmetic slurry facing the ground or in other configurations to avoid contact with rollers.

Thereafter, base substrate 68 is kiss cut die cut through more or less one layer by a precise die cavity 45 or any other suitable means. Base substrate 68 is rotary kiss cut die cut to a precision depth. The die is specifically designed to cut to such precise depth. Additionally, changing base rollers may fine tune the cutting depth of the die, if necessary to ensure that only one layer is cut. The area around the die cut on this one layer 68', consisting of polypropylene or other suitable substance with the quantity of dried cosmetic 51 laid over it, is removed from base substrate 68 and wound in a waste rewind 44. As illustrated in FIG. 6, through use of the appropriate roller tensions and speeds, and an extremely precise die cut, the waste rewind will contain only a portion of one layer from the base substrate with the associated cosmetic which was applied over this area. Removal of the portion of the polypropylene layer reveals adhesive 53 on the substrate 68 where the layer was removed. Thus, base substrate 68 at this point contains two complete layers of paper, and a plurality of areas containing a third polypropylene layer and cosmetic 51. These cosmetic areas are surrounded by adhesive 53.

At this point in equipment 60, base substrate 68 is merged with combined substrate 66 to form resulting substrate 70 such that the exposed permanent adhesive on substrate 68 binds the substrates together. The die cut areas 66' in combined substrate 66 should be substantially aligned with the areas of cosmetic 51 on base substrate 68. Next, die cut machine 54 is used to kiss cut die cut resulting substrate 70 through substantially all layers except the liner layer of base substrate 68. This forms individual cosmetic samples 71 from resulting substrate 70. Individual cosmetic sample 71 may be any shape or size to enable a consumer to view and/or sample cosmetics, such as, for example, a two inch by two inch square. The carrier liner or pressure sensitive backing may or may not be included. Waste rewind 56 removes the areas 68" around die cut regions of cosmetic samples 71, leaving a web of product 58.

Figure 7:
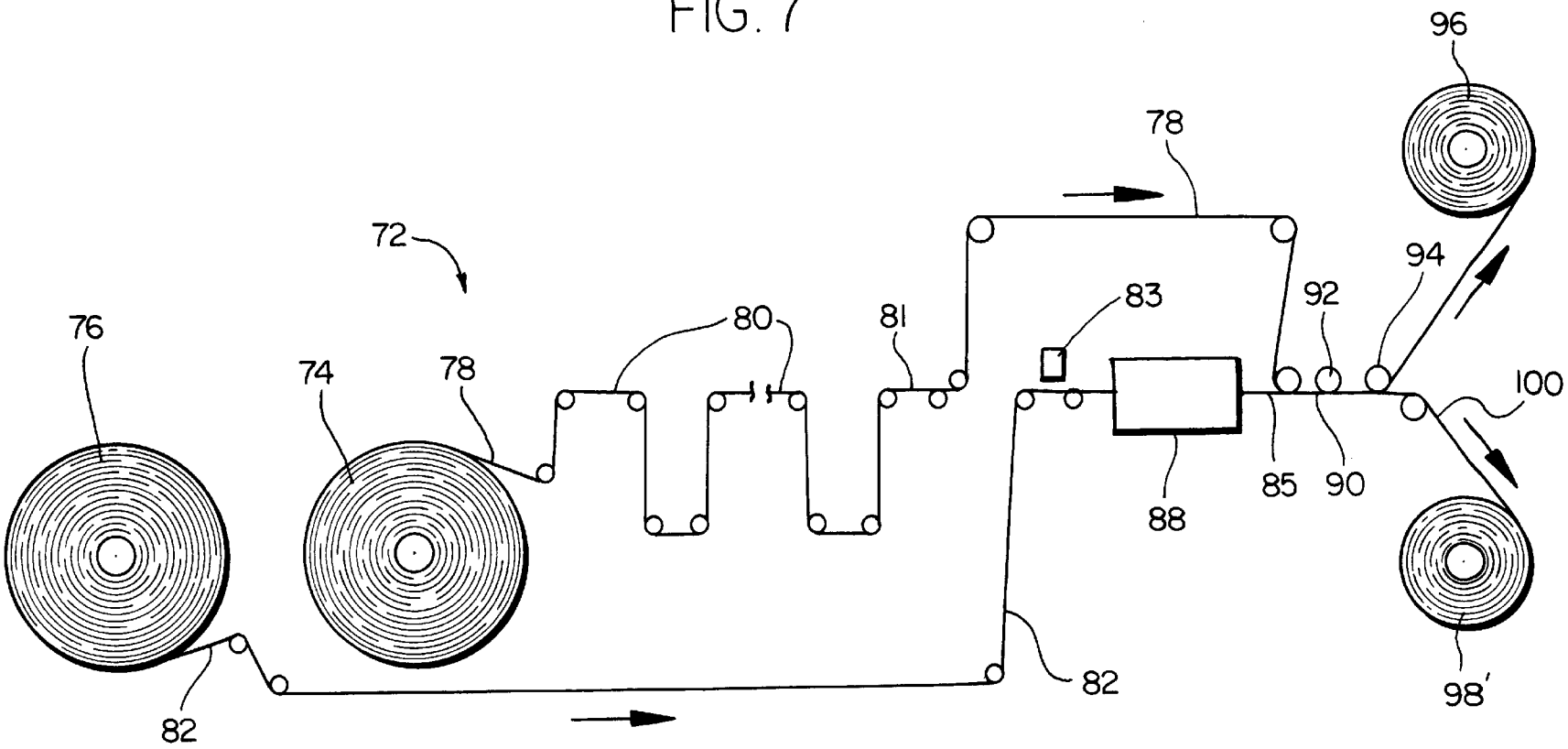
FIG. 7 is a diagrammatic view showing the steps of producing a cosmetic sampler using a narrow-web roll-to-roll two web machine.

Referring to FIG. 7, an alternative two web narrow-web equipment 72 is shown. Equipment 72 consists of two webs, web 74 and web 76. Web 74 supplies substrate 78 which makes up the cover sheet of the final cosmetic sampler 100. Substrate 78 is printed at printing station 80 by any suitable printing means, as more fully described above. Additional print stations may be utilized to print more colors, designs or details as desired. Substrate 78 may be coated be with an ultra violet curable varnish and cured with ultra violet lamps or similarly finished or protected if desired at station 81.

Web 76 feeds substrate 82 at the same speed as web 74. Discrete spaced apart areas of genuine cosmetics are applied using bulk thin film techniques, such as by pulsed, metered extrusion or by pulsed, metered spraying onto substrate 82 at station 83. Between areas of the applied cosmetics, areas of substantially clean substrate 82 should be present. The cosmetics on substrate 82 are then dried by dryer 88 or any other suitable means. Permanent adhesive is next applied at station 85 to the substantially clean areas between areas of applied cosmetic. If the permanent adhesive comes into contact with the cosmetic, that contacted adhesive may lose its adhesive characteristics. Substrate 82 is combined at this point with substrate 78 to form combined substrate 90. The combined substrate 90 is then perforation die cut at station 92 to enable a consumer to open the sampler and view the cosmetic. Finally, combined substrate 90 is kiss cut die cut at station 94. This die cutting may go through some or all of the layers, including the carrier layer, producing a finished product. The waste rewind 96 separates and removes unwanted portions from substrate 90, leaving product rewind 98' as the finished product. Alternatively, if individual samplers are to be provided, the product may be placed on a belt or stacker instead of a roller.

Figure 8:
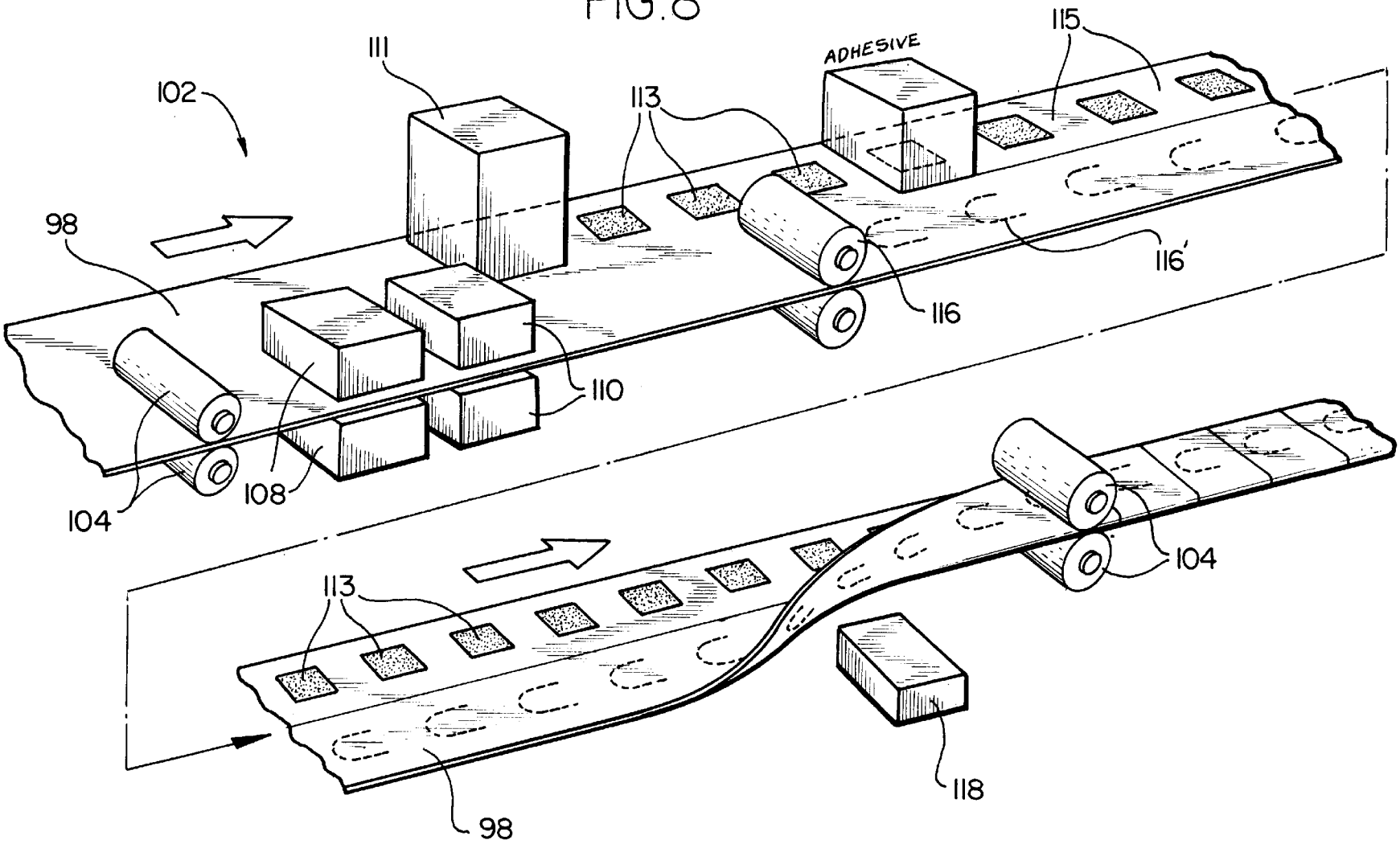
FIG. 8 is a diagrammatic view showing the steps of producing a cosmetic sampler using a wide-web offset press.

Referring to FIG. 8, there is illustrated a method of producing a cosmetic sampler using a wide web offset press with in-line finishing capabilities. Web offset equipment 102 can be obtained from any suitable source including Hantscho of Rockford, Ill. In-line finishing equipment can be obtained from any suitable source including Sheffer of Merrillville, Ind. Alternatively, the web press stage may be operated completely separate from the in-line finishing stage including being operated at separate facilities. On equipment which can perform both tasks, material can be run through web offset equipment incorporating the present invention at speeds of between about 300 and 1500 feet per minute. Equipment 102 contains web rollers 104 which feed substrate 98 into printing stations 108. Printing stations 108 print material on both sides of substrate 98 by any standard printing means. Angle or tension bars may be used to flip over substrate 98 to allow for printing with specific colors on either side. Multiple print stations may be employed to print on both sides of substrate 98 at substantially the same time, and in multiple colors and configurations. Substrate 98 is fed into oven 110 to dry the printing.

Next, areas of genuine cosmetic slurry 113 are applied to the substrate 98 at station 111 using bulk thin film techniques, such as by pulsed, metered extrusion or pulsed, metered spraying. In the wide web-offset equipment, multiple applicators of the same or different types of cosmetics may be situated either in parallel or in tandem. Proper ventilation is necessary to ensure that mists of cosmetic which do not immediately settle on substrate 98 do not contaminate the equipment or unintended areas of the web. The areas of cosmetic slurry 113 are dried by any suitable means including for example, an oven, infrared lamps or air flow. Since the wide-web equipment operates at faster speeds than the narrow-web equipment, the areas of cosmetic slurry 113 air dry more quickly. A tower or other suitable device may be utilized to allow the cosmetic more time to sufficiently dry. However, if the air does not completely dry the areas of cosmetic slurry 113, an oven or other suitable device should be employed.

Next, the area 116' to be folded over of substrate 98 is perforation die cut at station 116. An area of permanent adhesive 115 is applied to be around the dry areas of cosmetic 113 on substrate 98. Again, if the permanent adhesive 115 comes in contact with the dry cosmetic 113, that contacted area of adhesive 115 may diminish in its adhesive ability. At station 118, substrate 98 is plow folded in half so that the die cut areas align substantially with the areas of cosmetic. The panels of substrate 98 are laminated together or attached by any suitable method.

Figure 9:
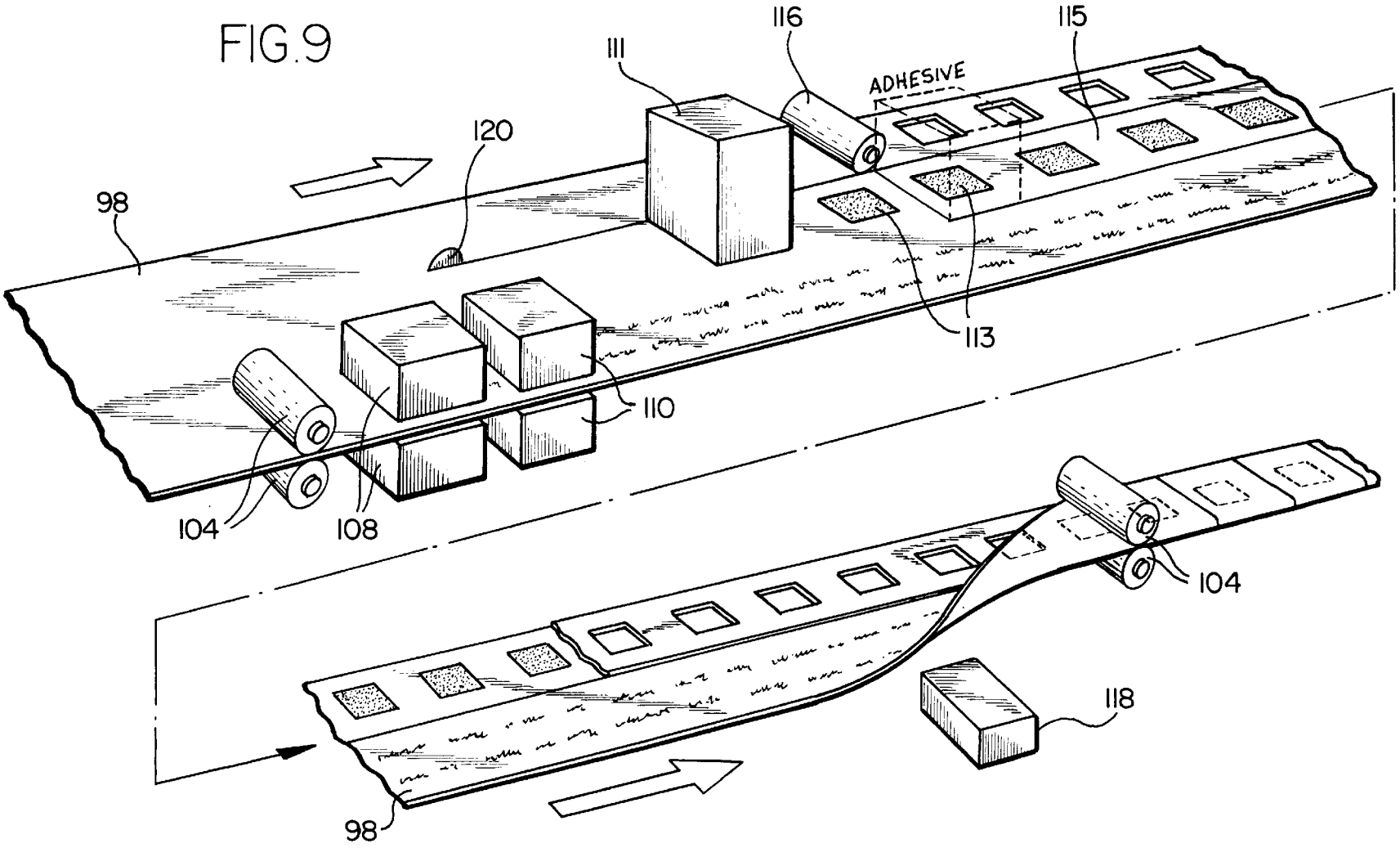
FIG. 9 is a diagrammatic view showing the steps of producing a cosmetic sampler using a wide-web offset press and a slitter.

Referring to FIG. 9, there is illustrated an alternative embodiment of producing a web of cosmetic samplers using wide-web offset equipment. Substrate 98 can be slit into two or more streams by any suitable method including, for example, blade 120, before applying the cosmetic slurry. The genuine cosmetic slurry is then applied to the designated stream of substrate 98 using bulk thin film techniques, such as by pulsed, metered spraying or pulsed, metered extrusion. Adhesive is applied to at least one of the streams of substrate 98. Another designated stream of substrate 98 is either die cut or used as a cover substrate. The cosmetic carrying stream of substrate 98 is plow folded. The multiple streams are all brought together and laminated. Another possible embodiment of the wide-web offset equipment is to use two separate roll stands, one for the base substrate which will contain genuine cosmetics and adhesive, and the second for the cover and intermediate substrate with die cut areas.

One example of a composition of the cosmetic slurry which was continuously sprayed onto a base substrate in the 3-web narrow web construction at 175 feet per minute is as follows (all percentages are by weight):

| | |
|---|---|
| Pearlescent eyeshadow: | 40% |
| Isopropyl Alcohol: | 54% |
| Polysiloxane: | 1% |
| Methyl Paraben: | 1% |
| Glycerine: | 2% |
| Fumed Silica: | 2% |

The cosmetic slurry can be stored in any suitable container. For extrusion or spraying, the slurry is usually mixed thoroughly and transferred directly into a feed tank. Upon completion of this transfer, the feed tank may be sealed and preferably pressurized, such as with compressed air, to a pressure of between about 2 psi and 100 psi.

Optionally, an inside shell or other suitable device may be inserted into the feed tank. The inside shell or other suitable device can be removed and disposed of and separately cleaned. This is more convenient and inexpensive than cleaning the entire container with every change in cosmetic. Preferably, an agitation system will be present in the container to maintain a constant composition in the slurry. The agitation system may, for example, incorporate moving blades or other similarly functioning devices. The agitation system should operate at a sufficient speed to ensure that the slurry remains in a suspended state suitable for extrusion or spraying as appropriate.

Before delivery in the spray head or extrusion head device, the bulk cosmetic may be filtered or otherwise cleansed to remove impurities. Impurities may clog the head of the sprayer or extruder. This clog may result in the hoses leading from the bulk cosmetic container to the head to become filled. This occurs because the slurry cannot flow through the orifice or the slurry temporarily clumps causing a slowdown. Filtration may be achieved by use of a screen capable of screening impurities larger than about between 60 and 100 microns. A second or third filtration system at other points in the extrusion or spraying system, including for example in the reservoir or near the spray head itself, is advisable.

For extrusion only, a slot nozzle head system, which may include a shim, delivers the slurry to the base substrate, and may be used in the present invention. This shim aids in preventing the head of the extruder slot nozzle from not completely closing by minimizing back pressure. Such a system will minimize "tailing," which refers to a trail on the ends of the area of cosmetic sample applied to the base substrate through extrusion. Not completely closing the head of the extruder can result in tailing.

The slurry should be applied to the base substrate by pulsed, metered spraying, continuous spraying or pulsed, metered extrusion. For pulsed, metered spraying and pulsed, metered extrusion, the process can be started and stopped in specified time or quantity increments by use of either a control mechanism within the extrusion or spraying apparatus, such as the Model 1250 AutoJet Controller/Driver from Spray Systems Co. of Wheaton, Ill., or by use of a human operator. This results in forming a plurality of areas covered with cosmetics, each with a definite beginning and end. For purposes of the present invention, this intermittent extrusion or spraying is known as "pulsed." Extrusion can be accomplished by any apparatus sufficient to extrude cosmetics at a suitable rate, including for example the WN-830 from Nordson of Duluth, Ga. Spraying can be accomplished by any apparatus sufficient to spray cosmetics at a suitable rate, including for example the AutoJet® available from Spraying Systems Co. of Wheaton, Ill. A continuous spray system does not require a control mechanism and uses a simpler and less expensive nozzle head.

Pulsed, metered spraying or extrusion may use less cosmetic than continuous spraying. Cosmetics often are expensive. Spraying or extruding cosmetics onto material which would not be viewable in the completed cosmetic sampler is often not desirable. In light of this, the use of pulsed, metered spraying or extrusion can be cost effective. In other instances, continuous spraying may be more desirous. Continuous spraying allows for easier creation of an even laydown of cosmetics. Additionally, continuous spraying may allow for faster press speeds.

Pulsed, metered spraying or extrusion can help to segregate the cosmetic from any adhesive used to close the base substrate to a cover. If cosmetics mix with an adhesive, the adhesive will lose its adhesion qualities and prevent the unit from remaining closed before use of the invention by an end user. Moreover, if the cosmetics mix with an adhesive, the adhesive may discolor and distort the final aesthetics of the product, making the product undesirable to consumers. Finally, if cosmetics mix with an adhesive, the adhesive printing plate, as described more fully hereafter, will carry an amount of cosmetics into the adhesive pan. This may cause the bulk adhesive to lose effectiveness. Pulsed, metered spraying or pulsed, metered extrusion can aid in separation of the adhesion and cosmetic.

The cosmetic slurry layer should be generally between approximately one mil and two mil in thickness. The shape of the cosmetic slurry layer may be approximately of a square, rectangle, oval or other desired shape. The area of the cosmetic slurry should be sufficient for rubbing off with a human finger, brush, sponge applicator or similarly functioning device and applied to the skin in sufficient quantities as to be evaluated by a customer.

Referring to FIGS. 10–27, there are illustrated various possible embodiments of the individual cosmetic sampler of the present invention. All embodiments may be produced with a carrier liner or similar pressure sensitive adhesive backing attached to the base. An intermediate sheet may contain die-cut openings to correspond to the area of cosmetic on the base. The die-cut openings may be in any suitable configuration to allow a person to lift the cover and reveal the cosmetic. The intermediate sheet is placed over adhesive onto the base. A top sheet is subsequently adhered on top of the intermediate sheet.

Figure 10:
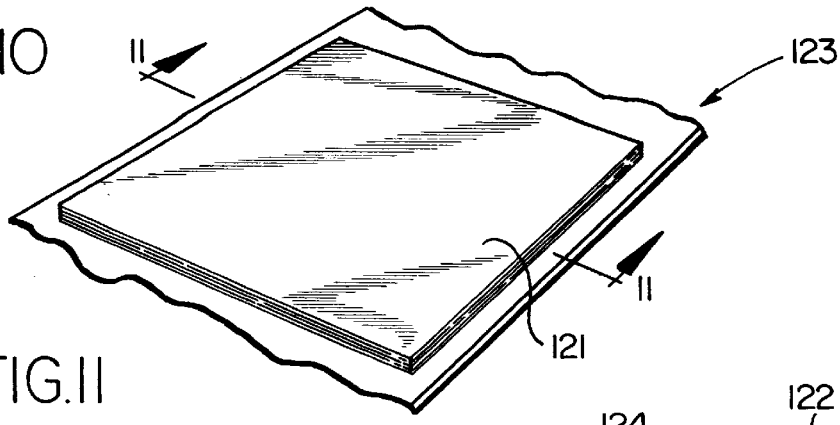
FIG. 10 is a perspective view of the sampler from the preferred embodiment.
Figure 11:
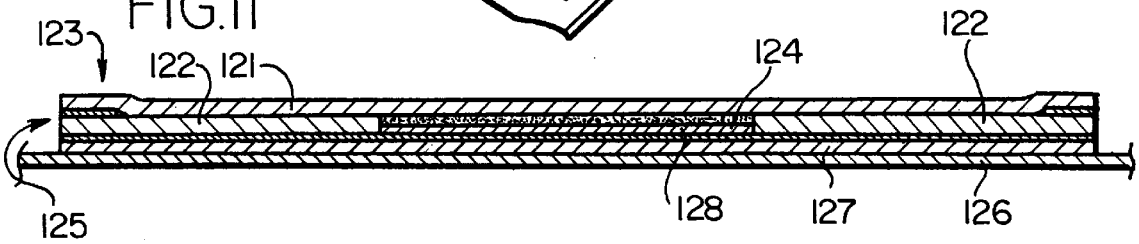
FIG. 11 is a cross-sectional view of the sampler of FIG. 10 taken along line 11—11.

Referring to FIGS. 10 and 11, there are illustrated the preferred embodiment of the present invention. In sampler 123, cover 121 is adhered to intermediate layer 122. Intermediate layer 122 has a die cut opening which is substantially aligned with genuine cosmetic 124. Base 125 consists of liner 126, bottom layer 127, and a portion of polypropylene layer 128.

Another embodiment of the foregoing invention illustrated in FIGS. 12–15 involves application of solely top sheet 130. Top sheet 130 is present over the adhesive layer 132 of the base layer 134. Perforations 136 are registered in top sheet 130 by any suitable means to correspond to the location of cosmetics 138 which are surrounded by adhesive on the base layer 134. The entire sample is attached to release liner 140'.

Another embodiment of the present invention illustrated in FIGS. 16–19 is sampler 140. Sampler 140 consists of liner layer 142, base layer 144 with cosmetics 146, and top layer 148 which consists of one sheet, folded in half. On one half of top layer 148, a die-cut opening 150 is placed so as to reveal the cosmetic 146 on base layer 144. Adhesive 147 adheres base layer 144 to half of top layer 148. Permanent or peelable adhesive 145 may be used to adhere the two halves of top layer 148 together.

Another embodiment illustrated in FIGS. 20–23 is cosmetic sampler 154, which is formed by folding over a single sheet 152 to form a Z-folded configuration and using liner layer 159. Folding is achieved by plow folding or any other suitable method. Sheet 152 becomes folded into top fold layer 155, middle fold layer 157, and bottom fold layer 158. Die-cut opening 153 which corresponds to the location of cosmetic 156 on the bottom fold layer 158 is registered by any suitable method. Sheet 152 is folded or laminated so that the middle fold layer 157 includes die-cut opening 153. The middle fold layer 157 should be attached to adhesive 162 on the bottom fold layer 158. Permanent or peelable adhesive 161 attach top fold layer 155 to middle fold layer 157.

Figure 24:
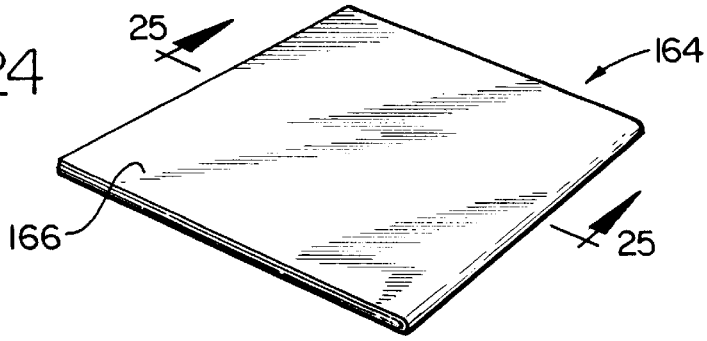
FIG. 24 is a perspective view of a sampler formed on a wide-web offset press.
Figure 25:
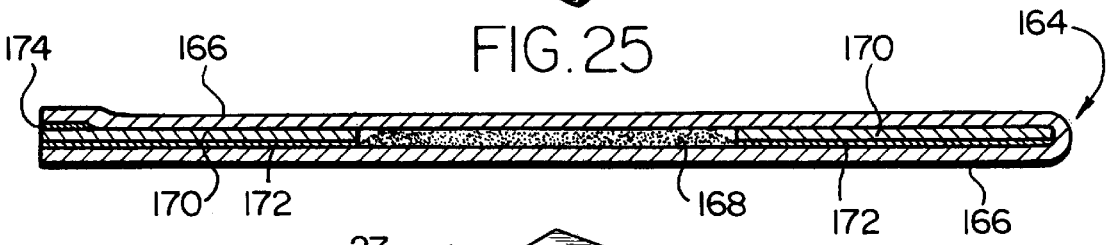
FIG. 25 is a cross-sectional view of the sampler of FIG. 24 taken along line 25—25.

Sampler 164, which may be formed using a wide web offset press in conjunction with the present invention, is illustrated in FIGS. 24 and 25. Folded layer 166 consists of paper or any other suitable substance. Cosmetic 168 is present on the bottom layer of folded layer 166. Intermediate layer 170 is attached to the area around cosmetic 168 on bottom layer of folded layer 166 by means of adhesive 172. Additionally, sampler 164 may be closed using peelable adhesive 174.

Figure 26:
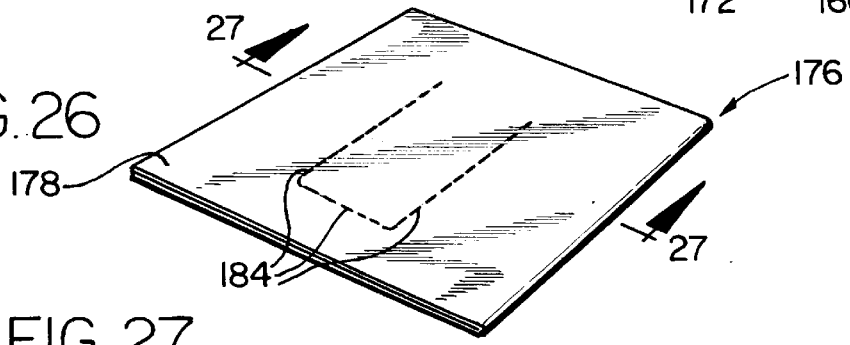
FIG. 26 is a perspective view of an alternative embodiment of a sampler formed using a wide-web offset press.
Figure 27:
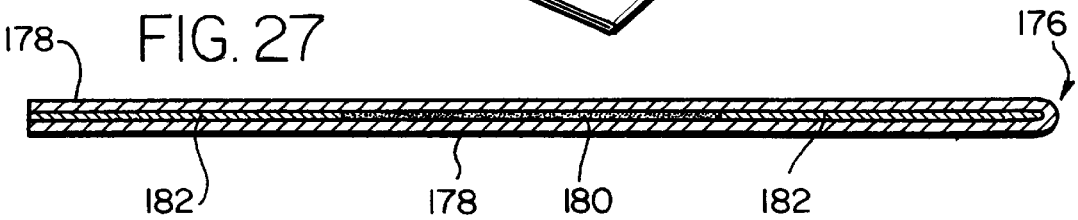
FIG. 27 is a cross-sectional view of the sampler of FIG. 26 taken long line 27—27.
Figure 12:
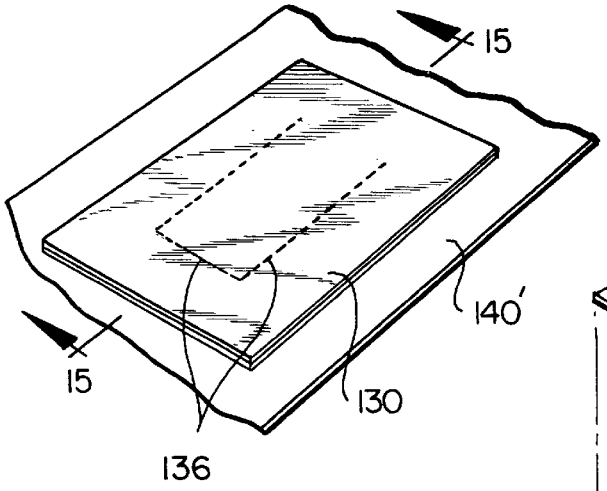
FIG. 12 is a perspective view of a two-layered sampler with the cover layer closed.
Figure 13:
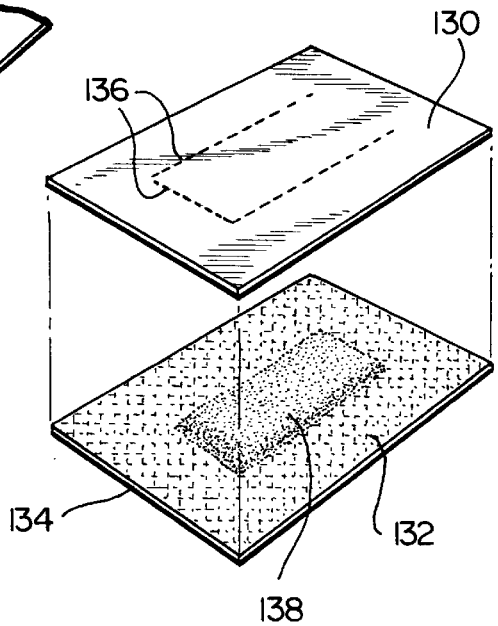
FIG. 13 is a perspective view of the two layers which form the sampler in FIG. 12.
Figure 14:
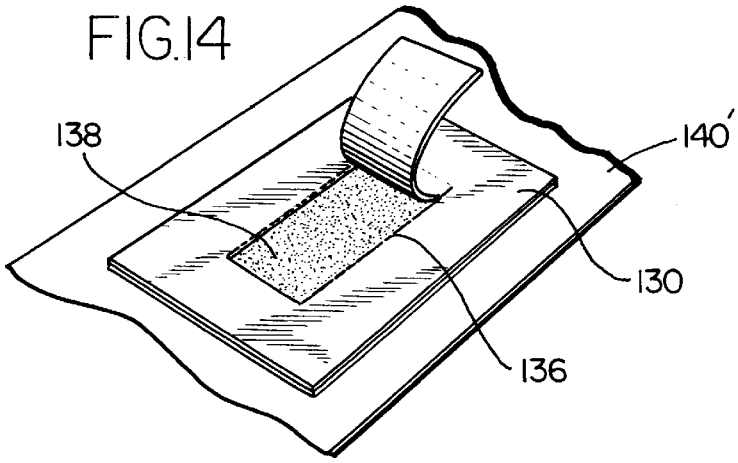
FIG. 14 is a perspective view of the sampler in FIG. 12 showing the cover substrate pulled back exposing the cosmetic.
Figure 15:
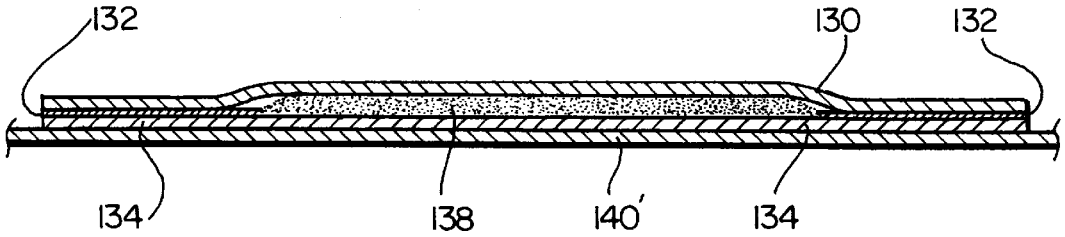
FIG. 15 is a cross-sectional view of the sampler of FIG. 12 taken along line 15—15.
Figure 16:
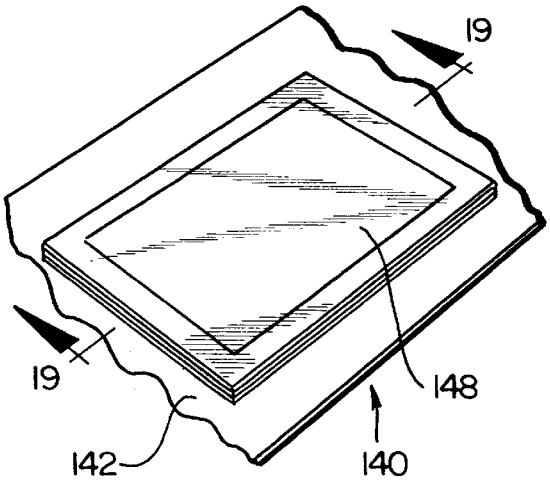
FIG. 16 is a perspective view of a two-layered folded sampler with the cover layer closed.
Figure 17:
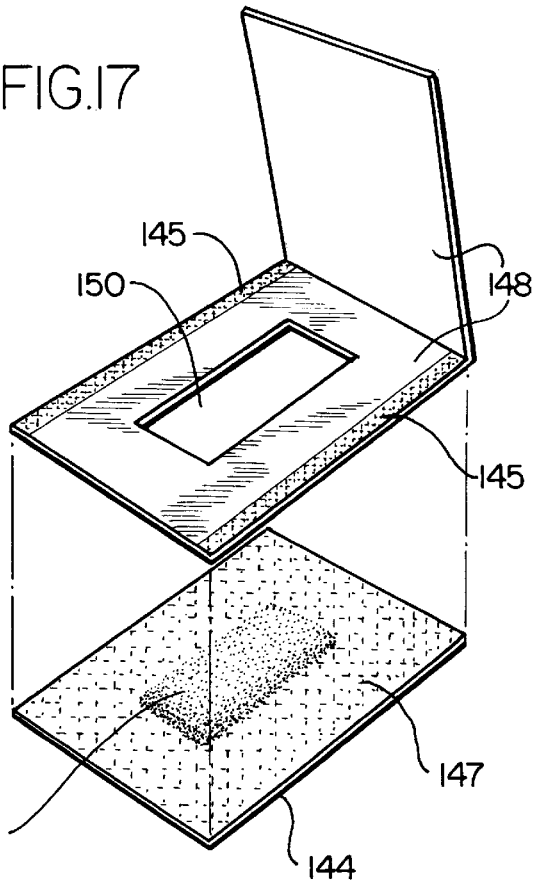
FIG. 17 is a perspective view of the two layers which form the sampler in FIG. 16.
Figure 18:
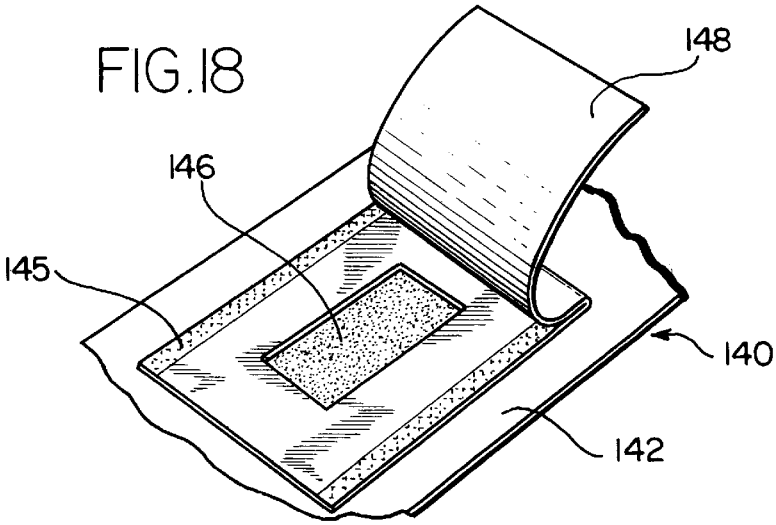
FIG. 18 is a perspective view of the sampler in FIG. 16 showing the cover substrate pulled back exposing the cosmetic.
Figure 19:
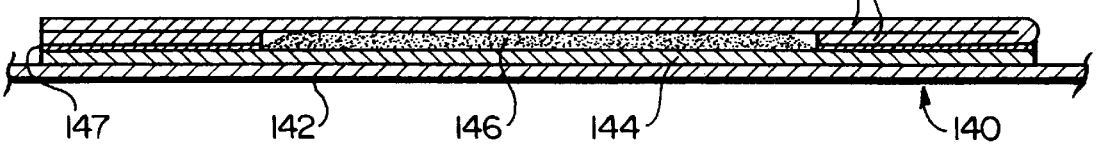
FIG. 19 is a cross-sectional view of the sampler of FIG. 16 taken along line 19—19.
Figure 20:
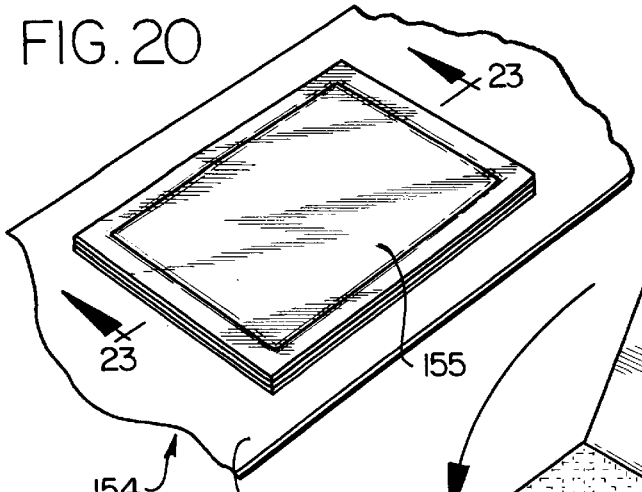
FIG. 20 is a perspective view of a Z-folded sampler with the cover layer closed.
Figure 21:
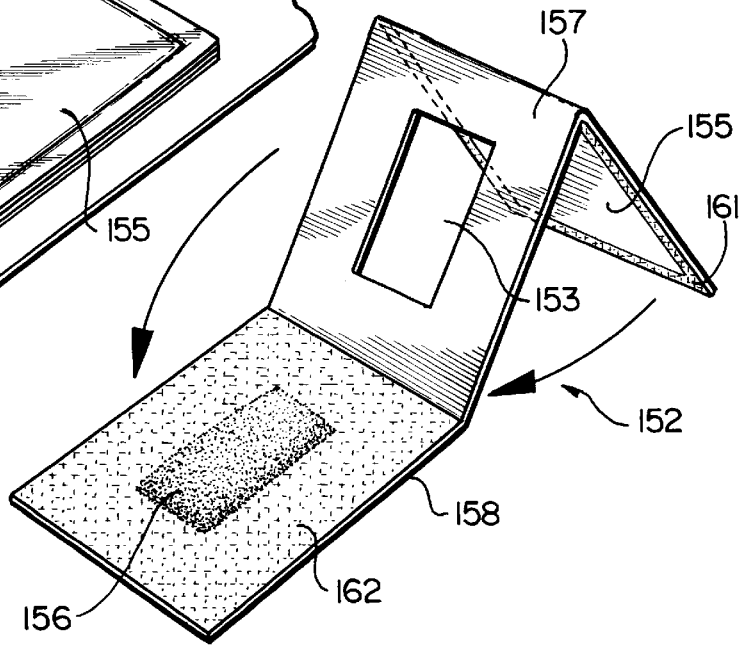
FIG. 21 is a perspective view of the Z-folded substrate which forms the sampler in FIG. 20.
Figure 22:
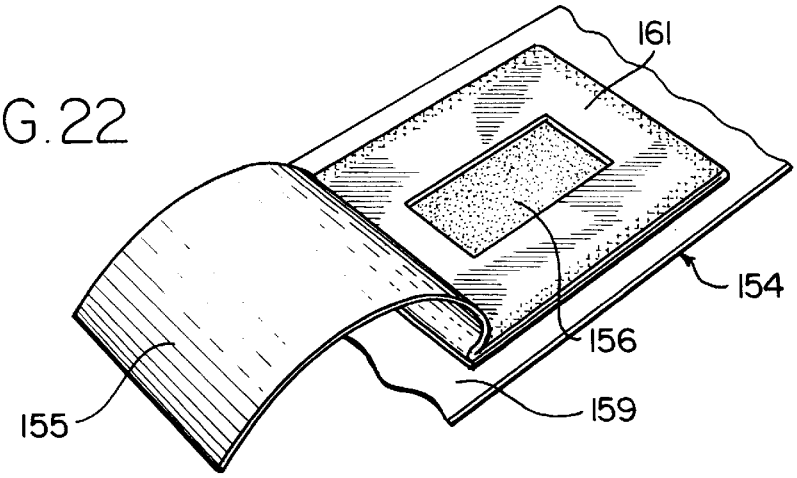
FIG. 22 is a perspective view of the sampler in FIG. 20 showing the cover substrate pulled back exposing the cosmetic.
Figure 23:
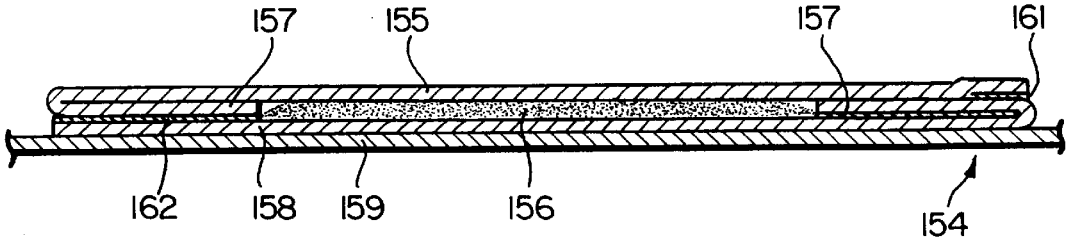
FIG. 23 is a cross-sectional view of the sampler of FIG. 20 taken along line 23—23.

In another embodiment of the present invention, sampler 176 is illustrated in FIGS. 26 and 27. Sampler 176 consists of sheet 178 folded over. Cosmetic 180 is present on the bottom half of sheet 178. Additionally, adhesive 182 marries the halves of sheet 178 together. A consumer may peel back perforations 184 on the top of sheet 178 to reveal cosmetic 180.

While the invention has been described with respect to certain preferred embodiments and, as will be appreciated by those skilled in the art, it is to be understood that the invention is capable of numerous changes, modifications and rearrangements and such changes, modifications and rearrangements are intended to be covered by the following claims.

We claim:

1. A method of producing a cosmetic sampler incorporating a genuine cosmetic that is to be sampled comprising:

conveying a base web substrate;

mixing the genuine cosmetic with a volatilizing solvent to form a homogeneous resulting mixture;

forming a plurality of discrete spaced apart thin film quantities of the resulting cosmetic mixture incorporating the genuine cosmetic that is to be sampled on the base web substrate;

drying the cosmetic mixture to evaporate the volatilizing solvent to form a dry continuous layer of the genuine cosmetic that adheres to the base web substrate and matches the color and appearance of the genuine cosmetic;

adhering a cover sheet web to the base web substrate that covers the dried cosmetic layer; and thereafter dividing the resulting web into a plurality of individual cosmetic samplers each comprising a base substrate, the dried layer of the genuine cosmetic on the base substrate and a cover sheet adhered to the base substrate covering the quantity of cosmetic adhered to the base substrate.

2. The method recited in claim 1 wherein said forming step comprises intermittently spraying a cosmetic mixture to the base web substrate.

3. The method recited in claim 1 wherein said forming step comprises intermittently extruding a cosmetic mixture to the base substrate.

4. The method of claim 1 wherein the volatilizing solvent is selected from the group consisting of isopropyl alcohol, N-propyl acetate and ethanol and mixtures thereof.

5. A method of producing a cosmetic sampler incorporating the genuine cosmetic that is to be sampled comprising the following steps:

conveying a base web substrate;

applying a thin layer of a cosmetic slurry incorporating the genuine cosmetic that is to be sampled to the base web substrate;

drying the slurry to form a dry cosmetic layer that adheres to the base web substrate;

removing a portion of the cosmetic layer on the base web substrate to form a plurality of spaced apart discrete thin film quantities of cosmetic adhered to the base web substrate;

attaching a cover sheet web over the base web substrate by use of an adhesive; and dividing the resulting web substantially longitudinally through areas of the resulting web not having a cosmetic layer into a plurality of individual cosmetic samplers each comprising of a base substrate, a cosmetic layer and a cover sheet adhered to the base substrate covering the cosmetic layer.

6. The method recited in claim 5 wherein said webs are conveyed on narrow-web equipment.

7. The method recited in claim 5 wherein said narrow-web equipment transports the webs at a rate of between approximately 75 and 300 feet per minute.

8. The method recited in claim 5 wherein said base web substrate comprises paper and a layer of silicone treated polypropylene.

9. The method recited in claim 5 wherein said cosmetic slurry is applied to the base web substrate by continuous spraying.

10. The method recited in claim 5 wherein said cosmetic slurry is applied to the base web substrate by pulsed, metered spraying.

11. The method recited in claim 5 wherein said cosmetic slurry is applied to the base web substrate by pulsed, metered extrusion.

12. The method recited in claim 5 wherein said base web substrate comprises at least two layers and said portion of the cosmetic layer on the base web substrate is removed by cutting a plurality of spaced apart cosmetic sample areas each through at least the outer layer of the base web substrate having the cosmetic layer disposed therein, and peeling back a portion of the cut outer layer to form the plurality of thin film quantities of the cosmetic slurry.

13. The method recited in claim 5 wherein said cover sheet web comprises a top sheet and an intermediate sheet, with the intermediate sheet having die cut areas to correspond to areas of the cosmetic slurry.

14. A method of producing a cosmetic sampler incorporating the genuine cosmetic that is to be sampled, comprising the following steps:

conveying a base web substrate;

mixing a genuine cosmetic with a volatizing solvent to form a homogeneous cosmetic mixture;

intermittently applying the homogeneous cosmetic mixture incorporating the genuine cosmetic that is to be sampled to sample areas on the base web substrate covered with the cosmetic to form a plurality of spaced-apart quantities of the cosmetic mixture;

drying the spaced-apart quantities of the cosmetic mixture to form a genuine cosmetic layer that adheres to the base web substrate;

applying an adhesive to a portion of the base substrate not covered by the cosmetic layer that circumscribes an area around the cosmetic sample;

covering a sheet over the base web substrate and covering the adhesive and dried cosmetic layer to form a resulting web; and dividing the resulting web through areas without a layer of cosmetic into a plurality of individual cosmetic samplers each comprising of a base substrate, a cosmetic layer and a cover sheet adhered to the base substrate covering the cosmetic layer.

15. The method recited in claim 14 wherein said cover sheet comprises a top sheet and an intermediate sheet, such intermediate sheet being attached to the base web substrate and covering the dried cosmetic sample.

16. The method recited in claim 15 wherein said intermediate sheet contains a cut out area exposing the dried cosmetic sample.

17. The method recited in claim 16 wherein said top sheet and intermediate sheet are each separate pieces.

18. The method recited in claim 16 wherein said top sheet and intermediate sheet are folded halves of a single piece.

19. The method recited in claim 15 wherein said top sheet, intermediate sheet and base web substrate are folded thirds of a single piece.

20. The method recited in claim 14 comprising the further step of registering perforations on the cover sheet of the cosmetic samplers.

21. The method recited in claim 14 wherein said base web substrate is conveyed by means of a web offset press.

22. The method recited in claim 21 wherein said web offset press supplies the base web substrate at a rate of between approximately 300 and 1500 feet per minute.

23. The method recited in claim 14 wherein said base web substrate is conveyed by means of narrow-web equipment.

24. The method recited in claim 23 wherein said narrow-web equipment supplies the base web substrate at a rate of between approximately 75 and 300 feet per minute.

25. The method recited in claim 14 wherein said cosmetic slurry is applied to the base web substrate by spraying.

26. The method recited in claim 25 wherein said cosmetic slurry has a composition suitable for spraying comprising by weight between about 10% and about 90% bulk cosmetic;

up to about 80% volatizing solvent; and up to about 7% adhesion/cohesion promoters.

27. The method recited in claim 14 wherein said cosmetic slurry is applied to the base web substrate by pulsed, metered extrusion.

28. The method recited in claim 27 wherein said cosmetic slurry has a composition suitable for extruding comprising by weight between about 10% and about 90% bulk cosmetic;

up to about 80% volatizing solvent; and up to about 7% adhesion/cohesion promoters.

29. The method recited in claim 14 wherein said dried cosmetic sample is between approximately 0.001 and 0.002 inches in thickness.

30. The method of claim 14 wherein said cover sheet web is coextensive with the base web substrate and substantially aligned and registered with the base web substrate.

31. The method of claim 25 wherein the viscosity of the homogeneous cosmetic slurry when sprayed is between about 50 and 500 centipoise.

32. The method of claim 14 wherein the volatizing solvent is present in the cosmetic mixture in an amount of between about 50 and 80 percent by weight of the total cosmetic mixture.

33. A method of producing a cosmetic sampler incorporating the genuine cosmetic that is to be sampled comprising:

conveying a base web substrate;

forming a plurality of discrete spaced apart thin film quantities of a cosmetic slurry incorporating the genuine cosmetic that is to be sampled on the base web substrate by continuously spraying a cosmetic slurry to the base web substrate; and removing a portion of a layer of the base substrate to reveal the plurality of areas of cosmetic slurry;

drying the cosmetic slurry to form a dry layer that adheres to the base web substrate;

adhering a cover sheet web to the base web substrate, covering the dried cosmetic sample; and thereafter dividing the resulting web into a plurality of individual cosmetic samplers each comprising a base substrate, the dried quantity of the cosmetic slurry on the base substrate and a cover sheet adhered to the base substrate covering the quantity of cosmetic slurry.

* * * * *